US006927667B1

(12) United States Patent
Busletta et al.

(10) Patent No.: US 6,927,667 B1
(45) Date of Patent: Aug. 9, 2005

(54) MAGNETIC DEVICE HAVING A SPRINGABLE WINDING

(75) Inventors: Galliano R. Busletta, Mesquite, TX (US); Robert J. Catalano, Mesquite, TX (US); Paul J. Offer, Jr., Dallas, TX (US); Robert J. Roessler, Rockwall, TX (US); Matthew A. Wilkowski, Mesquite, TX (US); William L. Woods, Kaufman, TX (US)

(73) Assignee: Tyco Electronics Power Systems, Inc., Mesquite, TX (US)

( * ) Notice: Subject to any disclaimer, the term of this patent is extended or adjusted under 35 U.S.C. 154(b) by 0 days.

(21) Appl. No.: 10/004,604

(22) Filed: Nov. 1, 2001

(51) Int. Cl.[7] ..... H01F 27/30

(52) U.S. Cl. ..... 336/208; 336/192; 336/180; 336/182; 336/223; 336/229

(58) Field of Search ..... 336/208, 192, 336/65, 83, 180, 182, 223, 229, 221, 222, 336/225, 200

(56) References Cited

U.S. PATENT DOCUMENTS 4,814,735 A * 3/1989 Williamson ..... 336/192

FOREIGN PATENT DOCUMENTS

JP 56012714 A * 2/1981

OTHER PUBLICATIONS

Technical Specification Sheet "Choke Coils CD-C-1314A Series" by FDK Corporation; 1 page; Oct. 2001.
Technical Specification Sheet "Choke Coils CD-C-1314B Series" by FDK Corporation; 1 page; Oct. 2001.

* cited by examiner

*Primary Examiner*—Lincoln Donovan
*Assistant Examiner*—Jennifer A. Poker

(57) ABSTRACT

A magnetic device is provided that may be employed with surface mount technology. In an advantageous embodiment, the magnetic device includes a magnetic core having a magnetic core half and a springable winding positioned about at least a portion of the magnetic core half. The springable winding includes a terminus biased against the magnetic core half.

20 Claims, 4 Drawing Sheets

MAGNETIC DEVICE HAVING A SPRINGABLE WINDING

TECHNICAL FIELD OF THE INVENTION

The present invention is directed, in general, to magnetic devices and, more specifically, to a magnetic device having a springable winding and a method of manufacture thereof.

BACKGROUND OF THE INVENTION

Technological advancements in manufacturing have become essential as a seemingly endless array of consumer electronic devices continue to flood the commercial market. One of the most promising manufacturing improvements is with the introduction of surface mount technology using reflow furnaces and a conductive adhesive, typically solder. Surface mount technology is rapidly replacing through-hole assembly of printed circuit board because of speed of assembly and the ease of achieving a higher packing density.

Depending upon the application, the marketplace today is continually demanding smaller, faster, lighter or increased power in these consumer electronic devices. Surface mount technology permits components to be mounted on both sides of a printed circuit board, if required, thereby increasing the packing density, i.e., the number of components per unit of area of the printed circuit board.

The same demands of smaller, faster, lighter or increased power generally require electrical components with higher current capacities. This is especially true for magnetic devices such as transformers and inductors. However, the design of transformers and inductors is dictated by elemental electrical engineering principles regarding the number of required turns of a winding as dictated by the desired output. As winding layers are added to achieve the desired inductance or transformer ratio, the magnetic device increases in thickness and as a result the inductor footprint requires additional printed circuit board space. The additional winding turns and higher current generate more heat that needs to be dissipated. Also, the heat generated by high current capacity inductors increases with the square of the current.

In an attempt to compensate for the size of the additional windings, some prior art magnetic devices have employed smaller conductors that have been decreased in size in some proportion to the increased winding size. Such configurations invariably lead to higher losses from the windings, rendering such a configuration undesirable. These factors and others necessitate larger or additional heat sinks to cope with the increased heat, further affecting the space constraints associated with the printed circuit boards.

Accordingly, what is needed in the art is a surface mount magnetic device having properties that avoid the disadvantages of the prior art.

SUMMARY OF THE INVENTION

To address the above-discussed deficiencies of the prior art, the present invention provides a magnetic device for use with surface mount technology. In one embodiment, the magnetic device includes a magnetic core and a springable winding positioned about at least a portion of the magnetic core wherein the springable winding has a terminus biased against the magnetic core.

The present invention also provides a method of manufacturing a magnetic device. In one embodiment, the method includes providing a magnetic core and positioning a springable winding about the magnetic core wherein the springable winding has a terminus biased against the magnetic core.

The foregoing has outlined an advantageous embodiment of the present invention so that those skilled in the art may better understand the detailed description of the invention that follows. Additional features of the invention will be described hereinafter that form the subject of the claims of the invention. Those skilled in the art should appreciate that they can readily use the disclosed conception and specific embodiment as a basis for designing or modifying other structures for carrying out the same purposes of the present invention. Those skilled in the art should also realize that such equivalent constructions do not depart from the spirit and scope of the invention in its broadest form.

BRIEF DESCRIPTION OF THE DRAWINGS

For a more complete understanding of the present invention, reference is now made to the following descriptions taken in conjunction with the accompanying drawings, in which.

DETAILED DESCRIPTION

Figure 1:
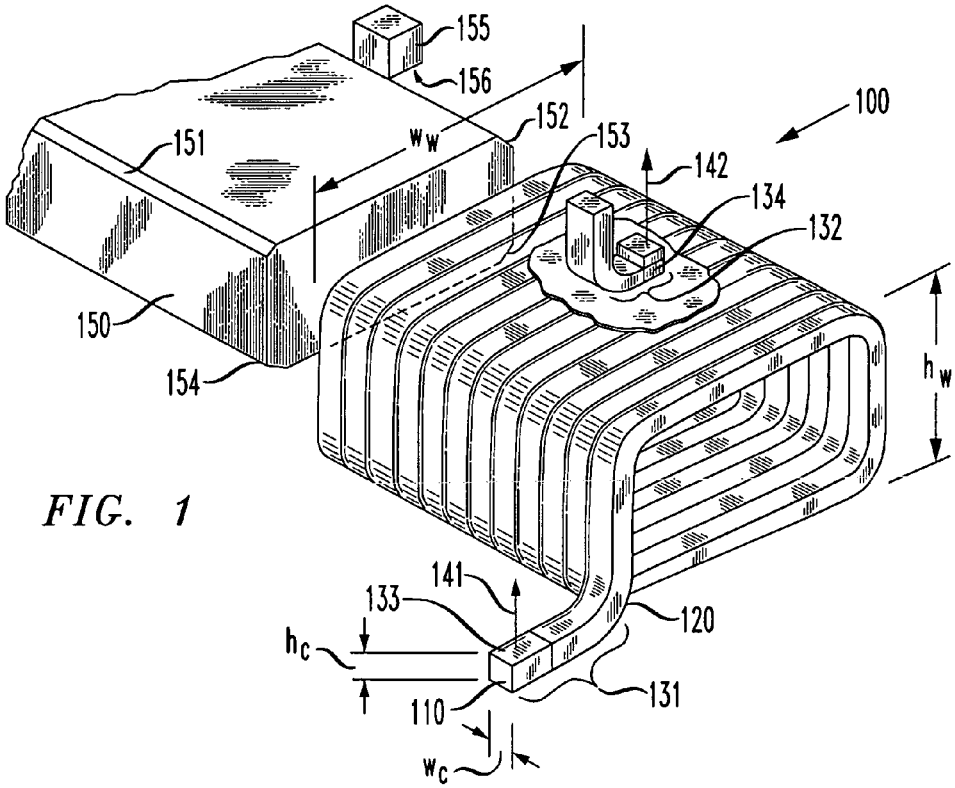
FIG. 1 illustrates a top isometric view with partial cutaway of one embodiment of a springable winding constructed according to the principles of the present invention.

Referring initially to FIG. 1, illustrated is a top isometric view with partial cutaway of one embodiment of a springable winding 100 constructed according to the principles of the present invention. The springable winding 100 includes a substantially planar conductor 110 having a dielectric 120 thereabout. In one embodiment, substantially planar means that the conductor width $w_c$ is substantially larger than the conductor height $h_c$. The substantially planar conductor 110 includes a conductive, springable material that has first and second termini 131, 132.

For the purposes of this discussion, a conductive springable material is any material that: (a) tends to recover its original shape when released after being distorted, and (b) is electrically conductive. For example, copper-clad, spring steel wire or copper and its alloys are suitable for this application. The springable material preferably has a spring constant ranging from about 750 to about 2000 grams/inch.

The springable winding 100 may be formed by winding the substantially planar conductor 110 about a mandrel 150. In the illustrated example, the mandrel 150 has chaffered corners 151, 152, 153, 154 around which the conductor 110 is wound to ease the wire transition from one face of the mandrel 150 to the next as the substantially planar conductor 110 is wound. In the illustrated embodiment, the springable winding 100 has been formed by winding the substantially planar conductor 110 about the mandrel 150 so that successive turns are adjacent each other in a single layer. The single layer winding 100 shown is advantageously smaller in height $h_w$ than multi-layered windings, thereby facilitating a lower profile surface mount magnetic device to be described below. Note that the springable winding 100, as shown, need not have a circular cross section as with many magnetic device windings. Instead, the springable winding 100 may have, for instance, an approximately-rectangular cross section. In a preferred embodiment, the winding may have an aspect ratio (width $w_w$ to height $h_w$) of at least about 1.6:1. Of course, other ranges of aspect ratios are within the broad scope of the present invention.

The first and second termini 131, 132 may be formed by reverse bending in a wire jig as is well known to one who is skilled in the art. In fact, to efficiently form the springable winding about the mandrel 150, a terminus (e.g., the second terminus 132) may be clamped to an underside 156 of a block 155 adjacent the mandrel 150 at the commencement of winding. The first terminus 131 may be completed by reversing the direction of winding about another block (not shown) when winding is complete. When completed, the springable winding 100 has a relaxed position in which the first and second termini 131, 132 are biased so that the springable winding 100 will tend to unwind in the direction as shown (see first and second arrows designated 141, 142). To provide electrical conductivity for the winding 100, each terminus 131, 132 has a portion of the insulation 120 removed at ends 133, 134, respectively. These ends 133, 134 may thus be soldered to conductive portions of a printed circuit board (not shown).

Figure 2:
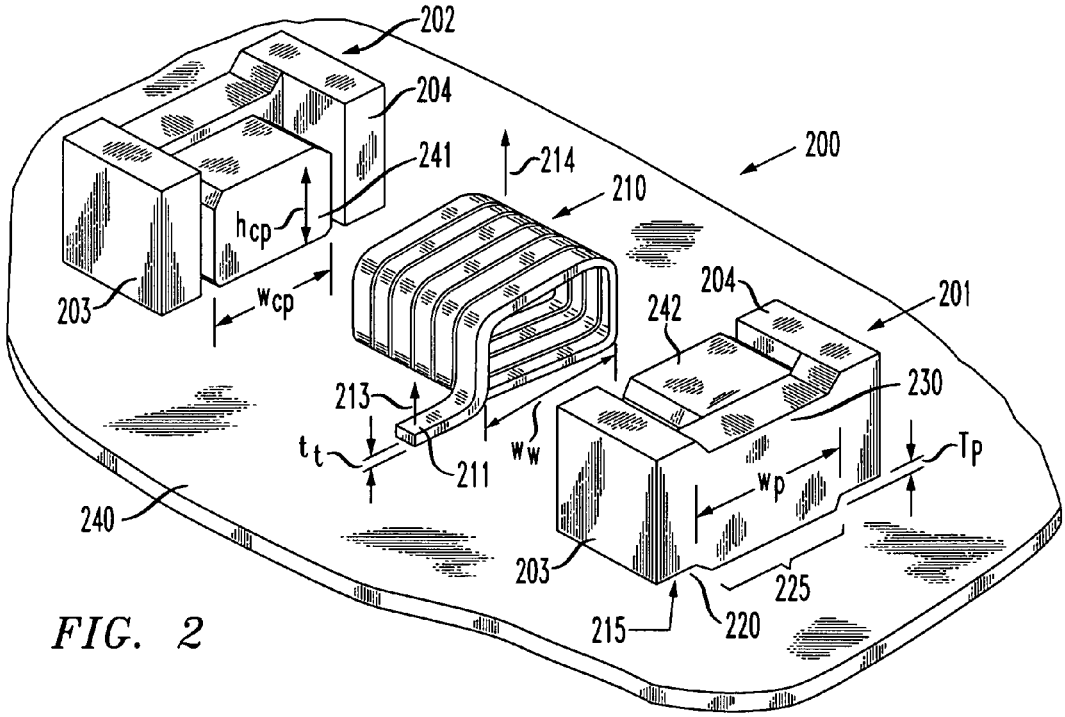
FIG. 2 illustrates an exploded top isometric view of an embodiment of a magnetic device constructed according to the principles of the present invention.

Referring now to FIG. 2, illustrated is an exploded top isometric view of an embodiment of a magnetic device 200 constructed according to the principles of the present invention. In the illustrated embodiment, the magnetic device 200 is an inductor including first and second magnetic core halves 201, 202 and a springable winding 210. Each magnetic core half 201, 202 has a convex profile 220 and a concave profile 230. The convex profile 220 includes a pedestal 225 that will cause a section of the inductor 200 to stand off slightly from a printed circuit board 240. The pedestal 225 may be integrally formed with the magnetic core halves 201, 202. The pedestal 225 may be a protuberance from a bottom surface 215 of the magnetic core halves 201, 202 and will be proximate an end of the winding 210 when the inductor 200 is assembled. Further, the pedestal 225 may have a width $w_p$ about equal to the width $w_w$ of the winding 210, and a minimum thickness $t_p$ about equal to the thickness $t_t$ of a terminus 211 of the winding 210. The minimum thickness $t_p$ enables a completed inductor 200 to sit approximately level upon the printed circuit board 240.

The magnetic core halves 201, 202 may be similar in construction to conventional magnetic cores of two coupled symmetrical halves each having a substantially E-shaped geometry. One who is skilled in the art will recognize that the completed magnetic device 200 may have a gapped or un-gapped core, as required. The magnetic core halves 201, 202 preferably include a ferromagnetic material, such as manganese-zinc, ferrite, or alloys thereof. Alternative embodiments include E-cores including other ferromagnetic materials having a cobalt-iron, nickel-iron, amorphous nickel-phosphide composition, or other suitable magnetic material. In order to accept the springable winding 210, each magnetic core half 201, 202 has a central portion 241, 242, respectively, that has an aspect ratio approximating the aspect ratio of the springable winding 210. That is, the width-to-height ($w_{cp}/h_{cp}$) ratio of the central portions 241, 242 is at least about 1.6:1. Of course, other ranges of width-to-height ($w_{cp}/h_{cp}$) ratios are within the broad scope of the present invention. Each magnetic core half 201, 202 also has outer legs 203, 204, respectively, against which the termini (one of which is illustrated and designated as 211) bias. The magnetic core halves 201, 202 are coupled together by any conventional means, e.g., adhesive, clips, etc. One who is skilled in the art is familiar with the assemblage of magnetic cores by coupling two E-core halves.

A principal advantage of the present invention is the biasing nature of the winding 210. Those skilled in the art understand that while windings may be wound directly on to a magnetic core, the conventional method includes windings which are wound directly on to a bobbin and subsequently forced over a magnetic core. This method often necessitates precise manufacturing, because the gap between the magnetic core central portion and outer legs is preferably minimized in order to conserve circuit board real estate, such that the windings are conventionally fabricated according to very tight manufacturing tolerances.

However, when using a springable material for the winding, forming the springable winding about a mandrel and using a bending jig to position and bias the terminus against the core is preferable. Note that forming the springable winding 210 includes forming the terminus 211 so as to naturally exert a force in the direction as shown (see first and second arrows designated 213, 214). The springable winding 210 may be temporarily enlarged to permit the springable winding 210 to slip over the central portions 241, 242 of the magnetic core halves 201, 202. Once released, the springable winding 210 biases one or more terminus 211 against the magnetic core halves 201, 202. Such bias retains the terminus 211 planar to the pedestal 225 and between the magnetic core halves 201, 202 and the substrate 240.

Preferably, the springable winding 210 includes an insulating layer (similar to layer 120 in FIG. 1) and, therefore, the magnetic device 200 will not require further encapsulation. As a result, the single layer of the springable winding 210 is better exposed to ambient air and more readily dissipates heat and consequently operates more efficiently. Of course, designs incorporating an encapsulant, however, are well within the broad scope of the present invention.

Figure 3A:
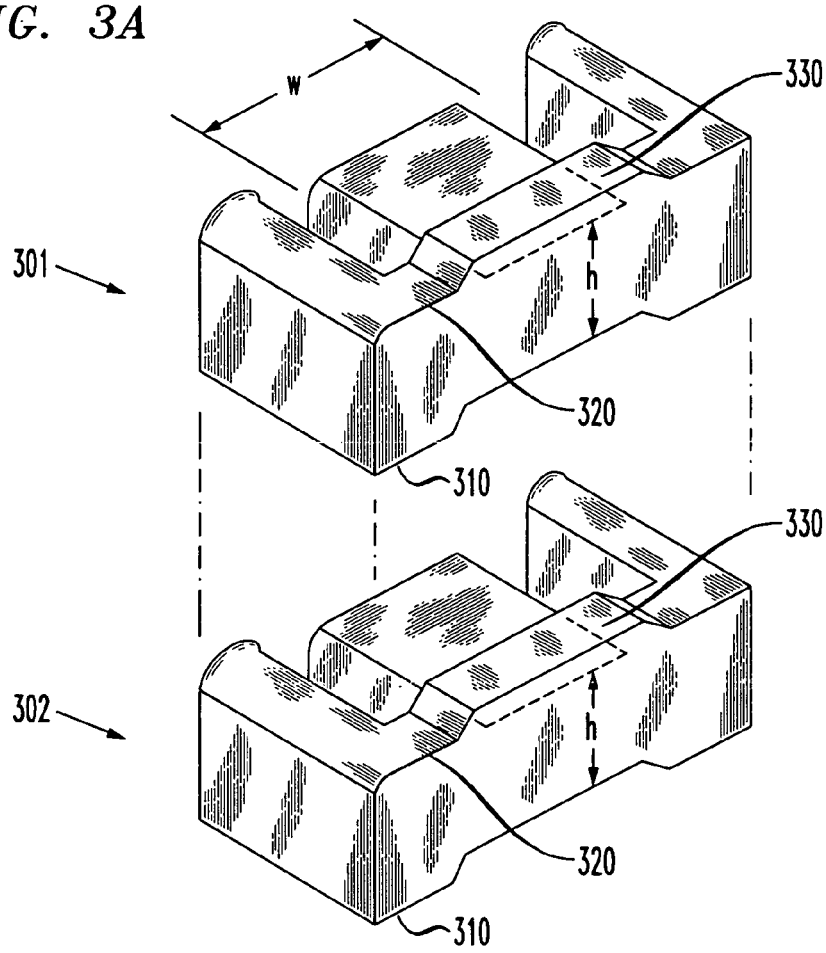
FIG. 3A illustrates an exploded isometric view of the bottom of a stack of an embodiment of portions of core halves constructed according to the principles of the present invention.

Referring now to FIG. 3A, illustrated is an exploded isometric bottom view of a stack of an embodiment of portions of core halves 301, 302 constructed according to the principles of the present invention. The core halves 301, 302 are essentially identical to the magnetic core halves 201, 202 of FIG. 2. Furthermore, each of the core halves 301, 302 has a concave profile 310 and an convex profile 320. The convex profile 320 of the first core half 301 is configured to nest with the concave profile 310 of the second core half 302. Such nesting of the core halves 301, 302 provides stability and eases handling of a stack of magnetic core halves during manufacturing of magnetic core halves as well as during manufacturing and assembly of magnetic devices such as inductors and transformers.

Figure 3B:
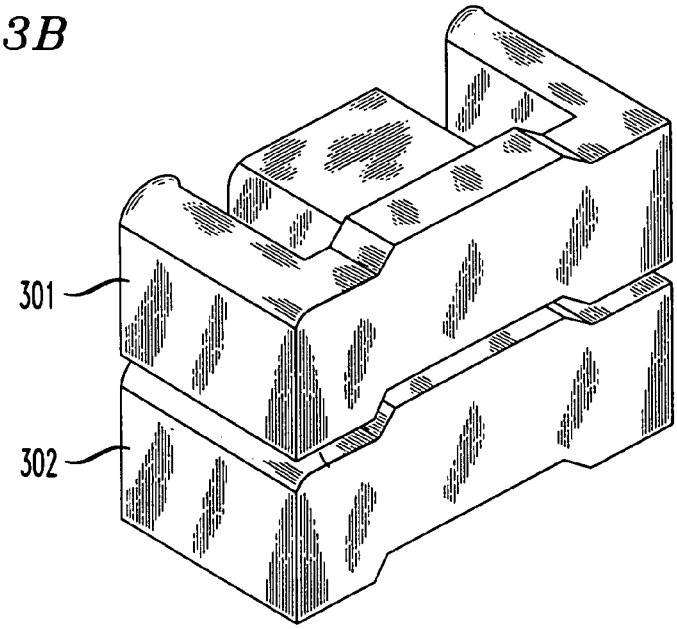
FIG. 3B illustrates an isometric view of an embodiment of portions of stacked core halves constructed according to the principles of the present invention.

That is, the nesting of the convex profile 320 and the mating concave profile 310 including a pedestal 330 is advantageous in that a plurality of magnetic cores may be stacked, or positioned on end, and aligned in order to facilitate shipping, packing, and assembly. FIG. 3B illustrates an isometric view of portions of the core halves 301, 302 as they would appear stacked.

Figure 4:
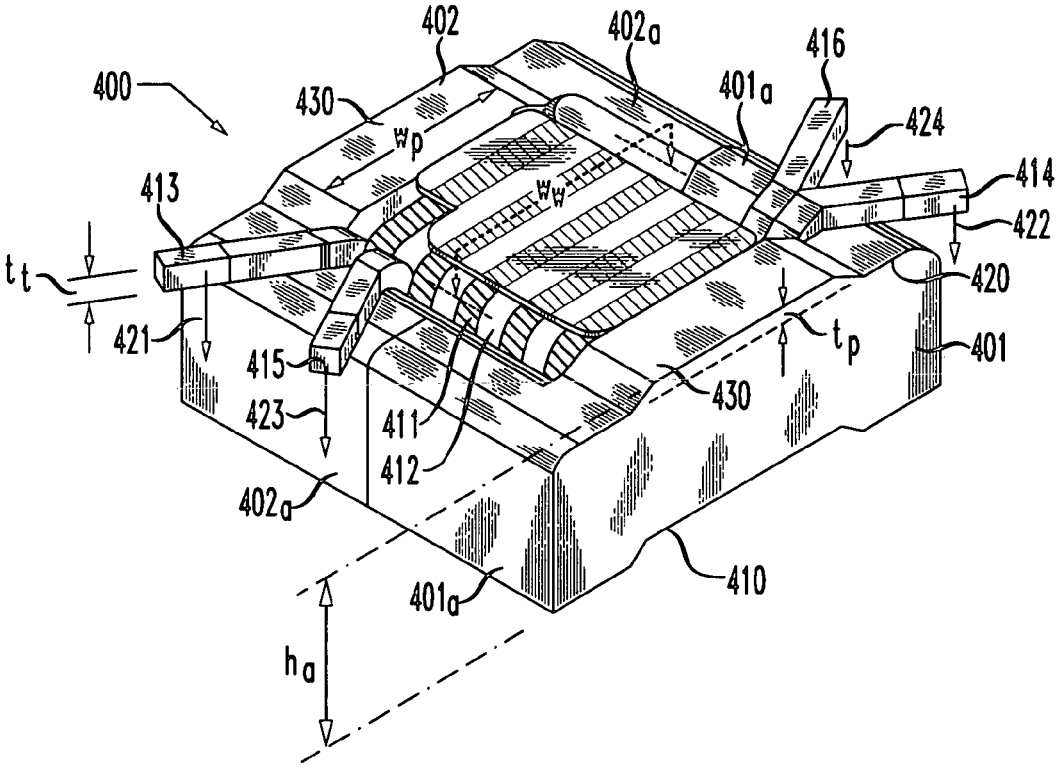
FIG. 4 illustrates a bottom isometric view of an alternative embodiment of a magnetic device constructed according to the principles of the present invention.

Referring now to FIG. 4 with continuing reference to FIG. 1, illustrated is a bottom isometric view of an alternative embodiment of a magnetic device 400 constructed according to the #=principles of the present invention. The magnetic device 400 includes first and second magnetic core halves 401, 402, and first and second springable windings 411, 412.

In this embodiment, the magnetic device 400 may be a coupled inductor, or transformer, having two windings 411, 412. The first and second magnetic core halves 401, 402 have outer legs 401*a*, 402*a*, central legs (not visible because of the windings 411, 412), and concave and convex profiles 410, 420, respectively. The convex profile 420 includes a pedestal 430 that will cause portions of the magnetic device 400 to stand off from a printed circuit board to be demonstrated below. The pedestal 430 may be integrally formed with the magnetic core halves 401, 402. The pedestal 430 has a width $w_p$ about equal to the width $w_w$ of the windings 411, 412, and a minimum thickness $t_p$. The minimum thickness $t_p$ enables the magnetic device 400 to sit approximately level upon a printed circuit board as will be shown below with respect to FIG. 5. In one embodiment, the above described features will allow the magnetic device 400 to rest upside-down in an aperture (not shown) in a printed circuit board, such that concave profile 410 is passed through the aperture and rests under the printed circuit board, and termini (as described herein) rest on a top surface of the printed circuit board.

The first and second springable windings 411, 412 have termini (referred to as first and second termini 413, 414 associated with the first springable winding 411, and third and fourth termini 415, 416 associated with the second springable winding 412). The first and second springable windings 411, 412 are wound in a manner similar to that discussed with respect to the springable winding 100 of FIG. 1. However, the first and second springable windings 411, 412 are interwound so that they remain coplanar when positioned about the center legs of the magnetic core halves 401, 402. In the illustrated embodiment, the first terminus 413 of the first springable winding 411 and the third terminus 415 of the second springable winding 412 are located proximate one another. However, those skilled in the pertinent art understand that all of the termini 413, 414, 415, 416 may be located proximate or distal from one another. Of course, magnetic device 400 may include only a single winding, as those skilled in the pertinent should understand that the specific number of windings in the magnetic device 400 is not limited by the scope of the present invention.

For this discussion, coplanar for a three dimensional object such as the first and second springable windings 411, 412 shall mean that the first turn of the second springable winding 412 is proximate and between the first and second turns of the first springable winding 411 such that the windings 411, 412 may be viewed as a plane. That is, the second springable winding 412 is adjacent and co-planar with the first springable winding 411 about each face of a mandrel (not shown but similar to the mandrel 150 of FIG. 1).

Therefore, both the first and second springable windings 411, 412 include a single layer, thereby minimizing an overall height of the magnetic device 400. For convenience in printed circuit board design and reflow assembly, the third terminus 415 may be folded away from the first terminus 413 so that the first springable winding 411 has the first and second termini 413, 414 at the extremes of the magnetic device 400 and the second springable winding 412 has the third and fourth termini 415, 416 toward the center of the magnetic device 400. The first and second springable windings 411, 412 may alternatively have color coded insulation or other identifying markings to ease correct connection to a circuit. The termini 413, 414, 415, 416 are biased against the outer legs 401*a*, 402*a*, respectively, as shown (see first, second, third and fourth arrows designated 421, 422, 423, 424).

The minimum height hd of the magnetic device 400 effected by the co-planar winding described above consequently will increase the platform area of the magnetic device 400. This increase in platform area increases the surface area available for heat dissipation, such that the magnetic device 400 may operate at a cooler temperature than comparable conventional components. The magnetic device 400 may be substantially free from encapsulation further enhancing the heat dissipation characteristics and a corresponding increase in efficiency. Efficiency loss in inductors is typically not dominated by ferrite core loss but by direct current loss in the winding that intensifies at higher temperatures. With a magnetic device substantially free of encapsulation, the first and second springable windings 411, 412 are exposed to the air and therefore dissipate heat and operate more efficiently.

Figure 5:
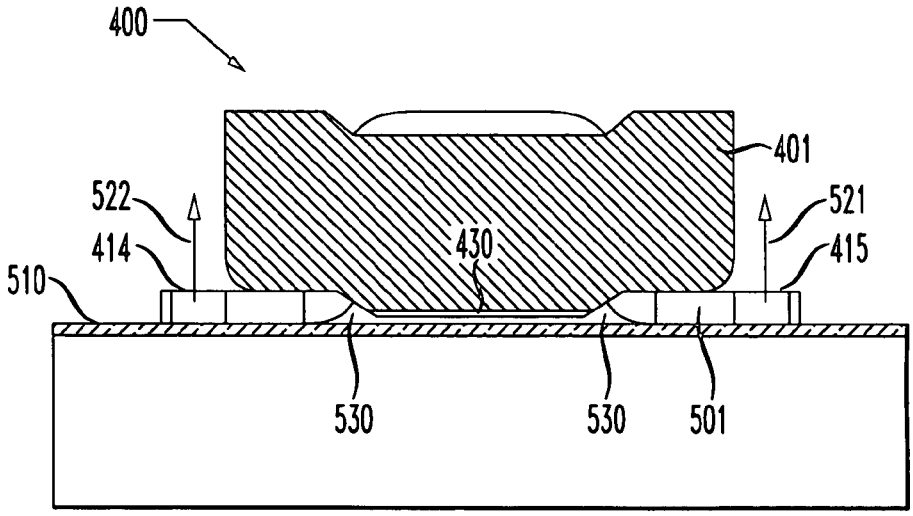
FIG. 5 illustrates an end view of an embodiment of a magnetic device mounted on a substrate constructed according to the principles of the present invention.

Referring now to FIG. 5, with continuing reference to FIG. 4, illustrated is an end view of the magnetic device 400 mounted on a substrate 510. In this manner, the termini (of which the second and third termini 414, 415 are visible) are interposed between the magnetic core halves (of which the first magnetic core halve 401 is visible) and the substrate 510. The first and second springable windings are biased as shown (see first and second arrows designated 521, 522) causing the termini, which are substantially planar, to conform to an undersurface 501 of the outer legs of the magnetic core halves. As can be seen, when the termini are combined with the pedestal 430, the magnetic device 400 rests approximately level upon the printed circuit board 510 when positioned preparatory to reflow soldering. The pedestal 430 and termini 414, 415 position the magnetic device 400 relative to the substrate 510 or a raised portion thereof (not shown) so that a slight air gap 530 may be present below the windings and above the substrate 510 to enhance cooling.

Figure 6:
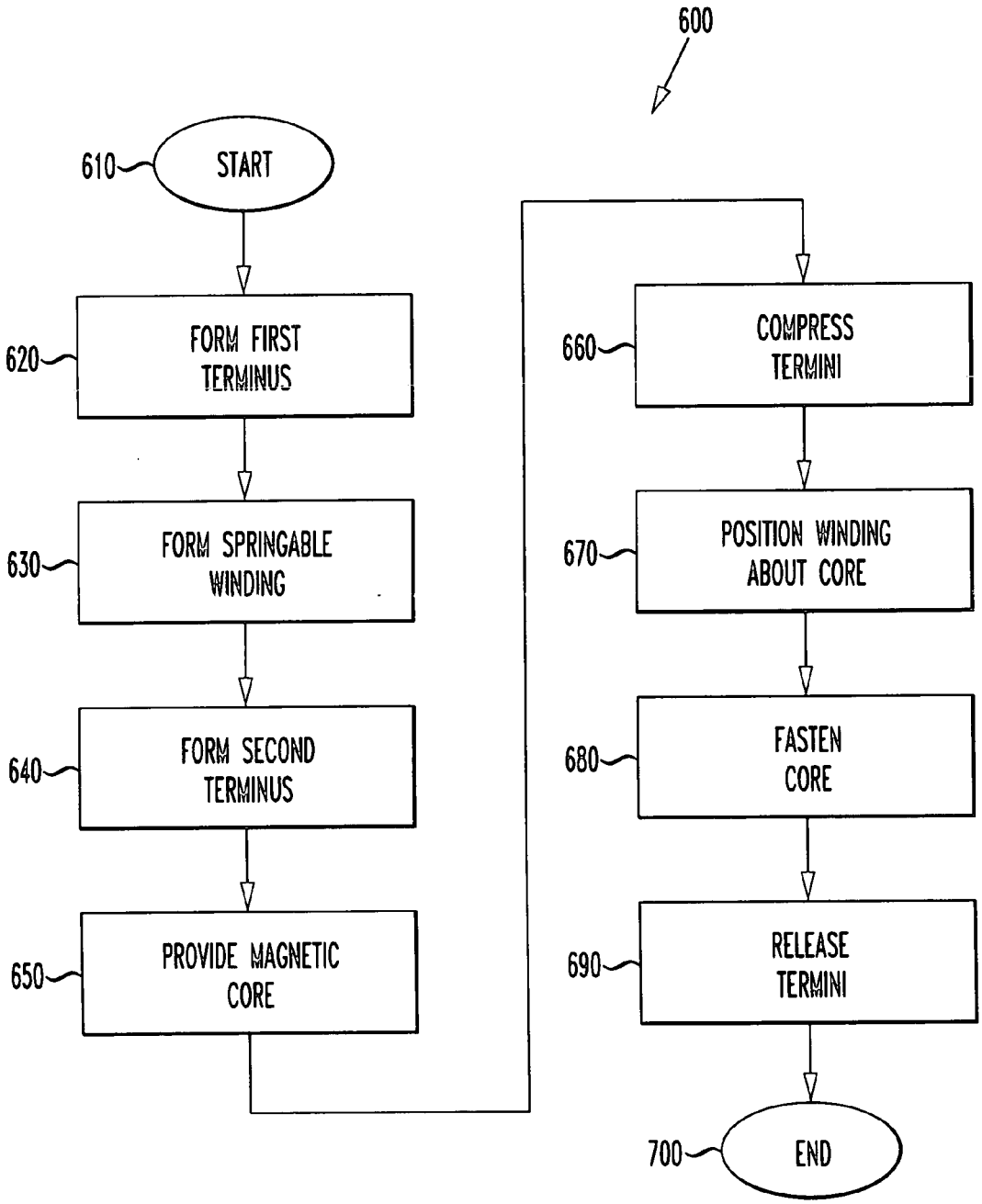
FIG. 6 illustrates a flow diagram of an embodiment of a method of fabricating a magnetic device constructed according to the principles of the present invention.

Referring now to FIG. 6, illustrated is a flow diagram of an embodiment of a method, generally designated 600, of fabricating a magnetic device constructed according to the principles of the present invention. The method 600 starts at start step 610. At a step 620, a first terminus of a springable winding is formed from substantially planar springable conductor. The springable winding may include one or more essentially planar conductors, each having two termini. The substantially planar conductor or wire has a dielectric thereabout. A portion of the dielectric about the termini of the springable winding may be removed to facilitate conduction between the termini and conductive portions of a substrate. In one embodiment, step 620 may further include coating the termini with an antioxidant, tin or its alloys, or other conventional processes known by those skilled in the art, in order to provide corrosion resistance for the termini. At a step 630, the springable winding is formed by bending the springable conductor about a mandrel for a required number of turns. The springable winding may have a spring constant ranging from about 750 to about 2000 grams/inch. At a step 640, the second terminus of the springable winding is formed from the substantially planar springable conductor. One who is skilled in the art should readily understand that an alternative embodiment may include forming the springable winding from two or more substantially planar springable conductors.

At a step 650, a magnetic core is provided. The magnetic core is similar to conventional magnetic cores, such that the magnetic core includes two symmetrical halves, each having a substantially E-shaped geometry. The magnetic core may include a ferromagnetic material including manganese-zinc, ferrite or alloys thereof. Alternatively, the magnetic core may have a cobalt-iron, nickel-iron or amorphous nickel-phosphide composition. One who is skilled in the art is familiar with magnetic cores and how magnetic device cores are formed. The magnetic core central portion should have an aspect ratio of at least 1.6:1. Of course, other ranges of aspect ratios are within the broad scope of the present invention.

In a preferred embodiment, each magnetic core half includes one or more integrally formed pedestals. Each pedestal may be formed as a protuberance on a bottom surface of the magnetic core half. The magnetic core half may further have convex and concave complementary profiles. The concave profile is configured to nest with a convex profile, including the pedestal, of a second magnetic core. Such nesting of the pedestal within the profile lends stability to a stack or line of magnetic cores. Nesting of this type is advantageous so that a plurality of magnetic cores may be stacked, or positioned on end, and aligned in order to facilitate gapping, shipping, handling, or assembly actions.

At a step 660, the springable winding is compressed by squeezing the termini together. At a step 670, the springable winding is positioned about the magnetic core. At a step 680, the magnetic core halves are fastened together by any suitable means. In one embodiment, the magnetic core halves may be interfacially bonded with a one-part adhesive that is thermally cured. In one embodiment, the magnetic core halves may be fastened by a conventional spring clip known to those skilled in the pertinent art. At a step 690, the termini are released, thereby biasing the winding termini against the magnetic core. At a step 700, the manufacturing process ends.

Although the present invention has been described in detail, those skilled in the art should understand that they can make various changes, substitutions and alterations herein without departing from the spirit and scope of the invention in its broadest form.

What is claimed is:

1. A magnetic device, comprising:

a magnetic core; and a springable winding having a terminus and a longitudinal axis wherein said springability is rotational and tending to rotate said terminus around said longitudinal axis, said springable winding positioned about at least a portion of said magnetic core and said springability further biasing said terminus against an underside of said magnetic core.

2. The magnetic device as recited in claim 1 wherein said terminus is configured to be interposed said underside and a printed circuit board.

3. The magnetic device as recited in claim 1 wherein said springable winding comprises a material having a spring constant ranging from about 750 to about 2000 grams/inch.

4. The magnetic device as recited in claim 1 wherein said magnetic core comprises an integrally formed pedestal extending from said underside of said magnetic core, said pedestal having a height substantially equal to a thickness of said terminus.

5. The magnetic device as recited in claim 1 wherein said magnetic core comprises a ferromagnetic material having a composition selected from a group consisting of:

cobalt-iron, manganese-zinc, nickel-iron, and amorphous nickel-phosphide.

6. The magnetic device as recited in claim 1 wherein said springable winding comprises a substantially-planar wire having a dielectric about said substantially-planar wire.

7. The magnetic device as recited in claim 1 wherein said magnetic core and said springable winding are substantially free of an encapsulant.

8. The magnetic device as recited in claim 1 wherein said magnetic device is selected from a group consisting of:

an inductor, a coupled inductor, and a transformer.

9. The magnetic device as recited in claim 1 wherein said magnetic core comprises first and second core halves.

10. The magnetic device as recited in claim 1 wherein at least a portion of said magnetic core has an aspect ratio of at least 1.6:1.

11. A magnetic device, comprising:

a magnetic core including a first magnetic E-core half having a central body and parallel legs, said first magnetic E-core half having a convex profile on a bottom surface thereof, said convex profile forming a central pedestal and a relieved undersurface on peripheral legs of said magnetic core half; and a springable winding having a terminus and a longitudinal axis wherein said springability is rotational and tending to rotate said terminus around said longitudinal axis, said springable winding positioned about at least a portion of said first magnetic core half and said springability further biasing said terminus against said bottom surface.

12. The magnetic device as recited in claim 11 wherein said springable winding comprises at least one terminus.

13. The magnetic device as recited in claim 11 wherein said convex profile comprises a pedestal located on said bottom surface.

14. The magnetic device as recited in claim 11 wherein said magnetic core half comprises a concave surface on a surface opposite said bottom surface.

15. The magnetic device as recited in claim 11 wherein said magnetic core half comprises outer legs and a center leg.

16. The magnetic device as recited in claim 15 wherein said springable winding is positioned about said center leg of said magnetic core half.

17. The magnetic device as recited in claim 11 wherein said magnetic device is located proximate an aperture of a substrate.

18. The magnetic device as recited in claim 11 wherein said springable winding comprises a substantially planar wire having a dielectric thereabout.

19. The magnetic device as recited in claim 11 wherein said magnetic core comprises a second magnetic core half, said springable winding positioned about at least a portion of said second magnetic core half.

20. The magnetic device as recited in claim 19 further comprising another springable winding positioned about a portion of said first magnetic core half and said second magnetic core half.

* * * * *